US008277149B2

(12) United States Patent
Sligar et al.

(10) Patent No.: US 8,277,149 B2
(45) Date of Patent: Oct. 2, 2012

(54) TENSIONABLE CABLE BOLT WITH CRIMPED SHAFT

(75) Inventors: Allen W. Sligar, Jeffersonville, KY (US); Clifford W. Perkins, Clay City, KY (US)

(73) Assignee: FCI Holdings Delaware, Inc., Wilmington, DE (US)

( * ) Notice: Subject to any disclaimer, the term of this patent is extended or adjusted under 35 U.S.C. 154(b) by 0 days.

(21) Appl. No.: 13/195,285

(22) Filed: Aug. 1, 2011

(65) Prior Publication Data

US 2012/0034035 A1 Feb. 9, 2012

Related U.S. Application Data

(60) Provisional application No. 61/370,604, filed on Aug. 4, 2010.

(51) Int. Cl.
*E21D 21/00* (2006.01)

(52) U.S. Cl. ..... 405/302.2; 405/259.1; 405/259.4; 405/259.5; 405/259.6

(58) Field of Classification Search ..... 405/259.1, 405/259.5, 259.6, 302.2
See application file for complete search history.

(56) References Cited

U.S. PATENT DOCUMENTS

| | | | | |
|---|---|---|---|---|
| 5,078,547 | A | 1/1992 | Calandra, Jr. et al. | |
| 5,244,314 | A | 9/1993 | Calandra, Jr. et al. | |
| 5,378,087 | A | 1/1995 | Locotos | |
| 5,525,013 | A | 6/1996 | Seegmiller et al. | |
| 5,531,545 | A | 7/1996 | Seegmiller et al. | |
| 5,556,233 | A | 9/1996 | Kovago | |
| 5,919,006 | A * | 7/1999 | Calandra et al. | 405/302.2 |
| 6,270,290 | B1 | 8/2001 | Stankus et al. | |
| 6,863,476 | B2 * | 3/2005 | Malkoski | 405/302.2 |
| 2009/0003940 | A1 | 1/2009 | Oldsen et al. | |
| 2009/0317197 | A1 * | 12/2009 | Hinton et al. | 405/302.2 |

* cited by examiner

*Primary Examiner* — Frederick L Lagman
(74) *Attorney, Agent, or Firm* — The Webb Law Firm

(57) ABSTRACT

A tensionable cable bolt including a length of multi-strand cable and an anchoring portion comprised of a shaft received on the cable and attached to the cable at a crimp portion comprising at least one primary crimp with at least one secondary crimp disposed within the primary crimp. The cable may include a mixing portion and the anchor portion may include an expansion anchor threaded onto the shaft. A method of manufacturing the tensionable cable bolt includes providing a length of multi-strand cable; providing an anchoring portion including a shaft; extending the cable through the shaft; and crimping the shaft to the cable to form at least one primary crimp with at least one secondary crimp disposed within the primary crimp. The method may further include threading an expansion anchor onto the shaft and/or providing a resin mixing portion along the cable.

20 Claims, 4 Drawing Sheets

TENSIONABLE CABLE BOLT WITH CRIMPED SHAFT

CROSS REFERENCE TO RELATED APPLICATION

The present application claims priority to U.S. Provisional Patent Application No. 61/370,604 filed Aug. 4, 2010 entitled "Tensionable Cable Bolt with Crimped Shaft", the entire disclosure of which is herein incorporated by reference.

BACKGROUND OF THE INVENTION

1. Field of the Invention

The present invention relates to tensionable cable bolts, in particular, a tensionable cable bolt which is adapted to be resin grouted and mechanically anchored in a mine roof bore hole and a method of manufacturing same.

2. Description of Related Art

Cable bolts are used in the mining industry for their ease of handling and installation. Cable bolts are substantially easier to fit into a bore hole than the elongated rods of conventional rod bolt systems. Regardless of the height limitations in a mine, cable bolts may be adapted to bore holes of any length due to their flexibility. The strength capacity of cables exceeds that of conventional rod bolts and, therefore, cable is the preferred reinforcement for certain roof conditions.

Conventional cable bolts are installed by placing a resin cartridge including catalyst and adhesive material into the blind end of a bore hole, inserting the cable bolt into the bore hole so that the upper end of the cable bolt rips open the resin cartridge and the resin flows in the annulus between the bore hole and the cable bolt, rotating the cable bolt to mix the resin catalyst and adhesive, and allowing the resin to set about the cable bolt.

Tensionable cable bolts are the subject of U.S. Pat. No. 5,378,087 to Locotos and U.S. Pat. No. 5,525,013 to Seegmiller et al. Each of the bolts described therein is resin grouted at the blind end of a bore hole and, following setting of the resin, they are tensioned by rotation of a nut on an externally-threaded shaft surrounding the free end of the cable. U.S. Pat. No. 5,531,545 to Seegmiller et al. and U.S. Pat. No. 5,556,233 to Kovago both disclose tensionable bolts with a mechanical anchor mounted on the upper end of the cable bolt and tensioning mechanisms disposed on their free ends for post-installation tensioning. These prior art cable bolts are tensionable and require two installation steps; namely, a first step to anchor the upper end of the cable bolt in the bore hole and a second step to tension the cable bolt.

The tensionable cable bolt described in U.S. Pat. No. 6,270,290 to Stankus et al. allows the resin mixing step and the tensioning to be achieved simultaneously. The cable bolt includes an elongated member having a mixing portion adapted to be resin grouted within a bore hole in rock and an anchoring portion adapted to be mechanically anchored to the rock. A drivehead is attached to a lower end of the elongated member. When resin is inserted into the bore hole and the drivehead is rotated, the mixing portion rotates and mixes the resin and the anchoring portion anchors to the rock. The mixing portion includes a plurality of birdcaged portions of the cable or similar mixing devices. The anchoring portion includes an externally-threaded shaft attached to the cable and a mechanical anchor threaded onto the threaded shaft. Generally, the shaft is hollow and is in the form of a sleeve through which the cable extends. The shaft may be crimped to the cable. Rotating the drivehead simultaneously rotates the resin mixing portion and the shaft resulting in mixing of the resin in the bore hole, and the threading of the mechanical anchor onto the shaft causing the mechanical anchor to expand and engage the rock, thereby tensioning the cable bolt.

SUMMARY OF THE INVENTION

The tensionable cable bolt of the present invention includes a length of multi-strand cable having a drive end and a distal end and adapted to be resin grouted in a bore hole in rock and an anchoring portion comprised of a shaft received on the cable. The shaft is attached to the cable at a crimp portion comprising at least one primary crimp with at least one secondary crimp disposed within the primary crimp. The secondary crimp may have a smaller surface area than the primary crimp, a greater depth than the primary crimp, or both and may be of sufficient depth to cause the shaft to bulge outwardly in a region adjacent the secondary crimps. The cable may include a mixing portion and the anchor portion may include an expansion anchor threaded onto the shaft.

A method of manufacturing the tensionable cable bolt of the present invention includes providing a length of multi-strand cable having a drive end and a distal end and adapted to be resin grouted in a bore hole in rock; providing an anchoring portion including a shaft; extending the cable through the shaft; and crimping the shaft to the cable to form at least one primary crimp with at least one secondary crimp disposed within the primary crimp. The primary crimp and the secondary crimp may be formed on the shaft at the same time or may be sequentially formed on the shaft. The method may further include threading an expansion anchor onto the shaft and/or providing a resin mixing portion along the cable.

DETAILED DESCRIPTION OF THE INVENTION

Figure 1:
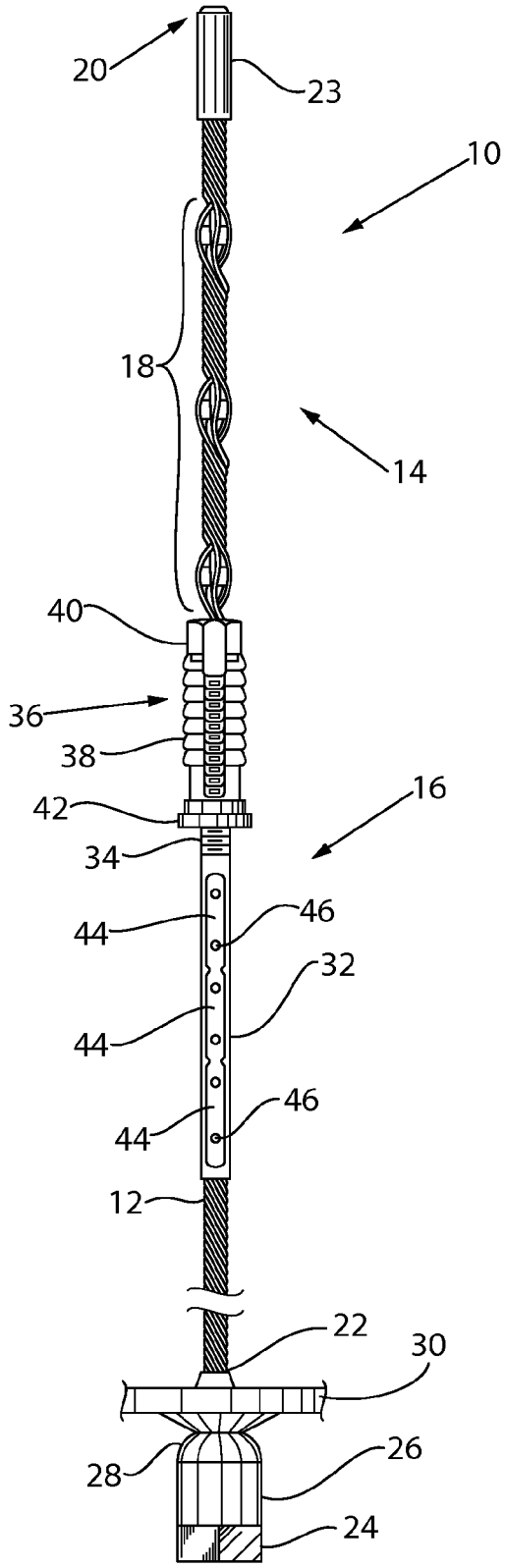
FIG. 1 is a side elevation of a tensionable cable bolt of the present invention.

For purposes of the description hereinafter, the terms "upper", "lower", "right", "left", "vertical", "horizontal", "top", "bottom", and derivatives thereof, shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

The tensionable cable bolt of the present invention is similar in design to the tensionable cable bolt disclosed in U.S. Pat. No. 6,270,290 to Stankus et al., incorporated herein by reference. However, the present invention allows for more torque to be applied to the cable bolt and better tensioning to be achieved.

FIG. 1 illustrates a tensionable cable bolt 10 made in accordance with the present invention. The cable bolt 10 is adapted to be inserted into a drilled bore hole of a rock formation to support the rock formation, such as a mine roof overlaying a mine shaft, and the like.

The cable bolt 10 includes a cable 12 adapted to be received within the bore hole. A first portion 14 of the cable 12 is adapted to be resin grouted within the bore hole while an anchor portion 16 is adapted to be mechanically anchored within the bore hole. The first portion 14 includes a mixing portion 18 for mixing resin within the bore hole. The mixing portion 18 may include a plurality of birdcages positioned at spaced locations along the first portion 14 of the cable bolt 10. Alternatively, the mixing portion 18 may also include a plurality of shafts or buttons (not shown) surrounding the cable 12 attached at various points along the cable 12. The provision of birdcages or buttons improves the mixing of the resin during installation and increases the bond strength of the resin to the cable bolt 10. A resin compactor (not shown) may be disposed below the first portion 14 of the cable bolt 10. Alternatively, the cable bolts of the present invention may have no mixing portion 18 such that the first portion 14 comprises an undisturbed length of cable.

The cable 12 has a distal end 20, which is placed into the blind end of the bore hole, and a drive end 22. A sleeve or button 23 is crimped on the distal end 20 of the cable 12 to secure the strands of the cable 12. A separate attached drivehead 24 is mounted onto the drive end 22 of the cable 12. The drivehead 24 includes an exterior drive surface which may have a polygonal cross section, such as a square or hexagon, so that the drivehead 24 can be readily driven by conventional mine roof bolt installation equipment (not shown). The drivehead 24 is mounted to the drive end 22 of the cable 12 with sufficient attachment strength to permit rotation of the cable bolt 10 with a mine roof bolt installing machine. A barrel and wedge assembly 26 may be mounted on the cable 12 adjacent the drivehead 24. The barrel and wedge assembly 26 is a well-known and accepted mechanism for receiving the loading requirements of a cable bolt 10. In operation, the barrel and wedge assembly 26 may be adjacent to and support a washer 28 and/or a bearing plate 30. The drivehead 24 is used for rotating the cable bolt 10, whereas the load of the mine roof is borne by the barrel and wedge assembly 26.

The anchor portion 16 includes a shaft 32 having a central bore adapted to receive the cable 12. The inside diameter of the shaft 32 is sized to accept the cable 12. The attachment of the shaft 32 to the cable 12 is sufficiently strong to maintain attachment of the shaft 32 to the cable 12 so that when the cable 12 is rotated, the shaft 32 rotates therewith as a unit. An end of the shaft 32 distal from the drive end 22 may also include external threads 34. The threads 34 are adapted to accept an expansion anchor 36 having an expansion shell 38, an internally-threaded plug 40, and an internally-threaded support mechanism 42. An outside diameter of the shaft 32 is sized to allow the expansion anchor 36 to be threaded thereon and to allow the cable bolt 10 to be inserted into a conventional mine roof bore hole. The threaded support mechanism 42 is threaded onto the shaft 32 and supports the expansion shell 38 in a conventional manner. Suitable expansion anchors are disclosed in U.S. Pat. Nos. 5,244,314 and 5,078,547 to Calandra, Jr. et al., both incorporated herein by reference.

If a mixing portion 18 is present, it may be positioned intermediate to the distal end 20 of the cable 12 and the expansion anchor 36 (FIGS. 1 and 4) or between the shaft 32 and the drive end 22 of the cable 12 (FIG. 1).

Figure 2A:
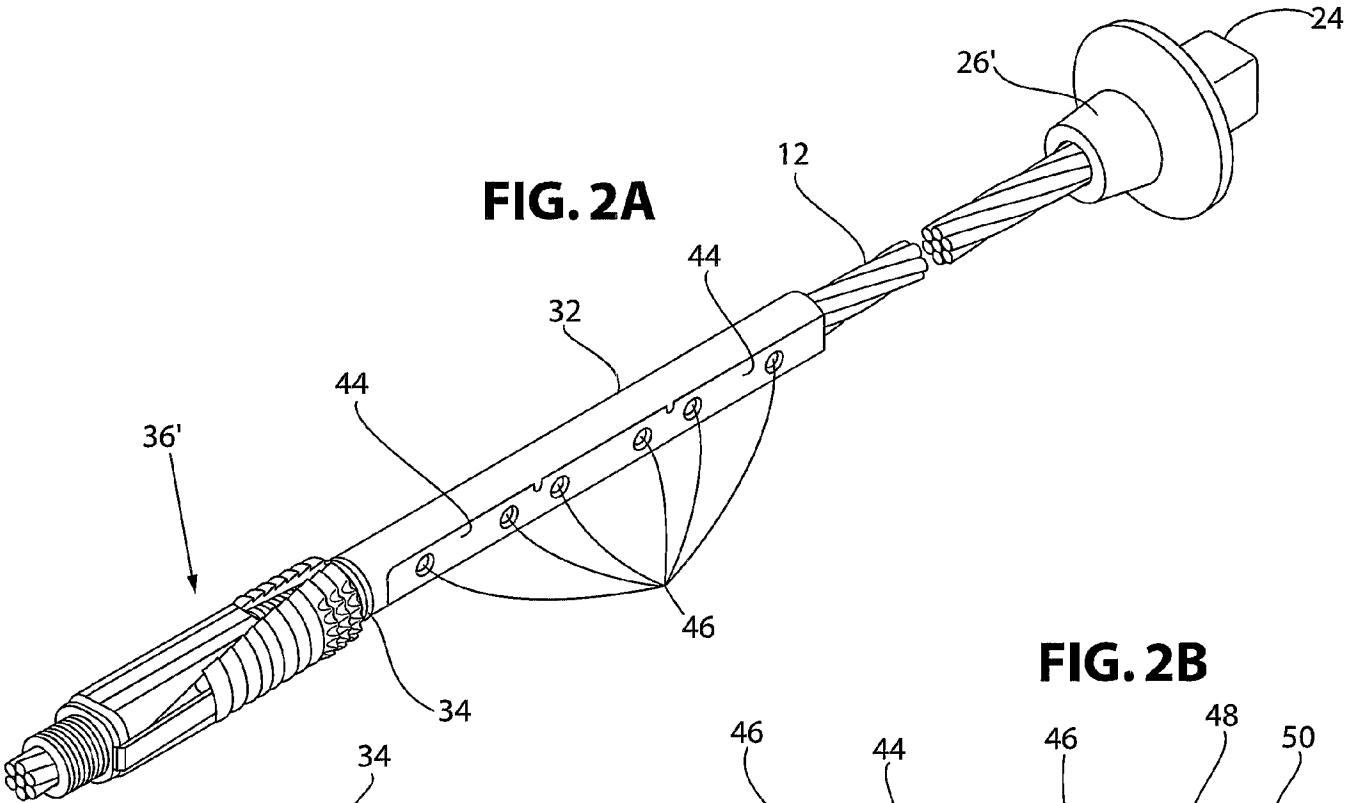
FIG. 2A is a slightly modified perspective view of the anchor portion of the tensionable cable bolt of FIG. 1.
Figure 2B:
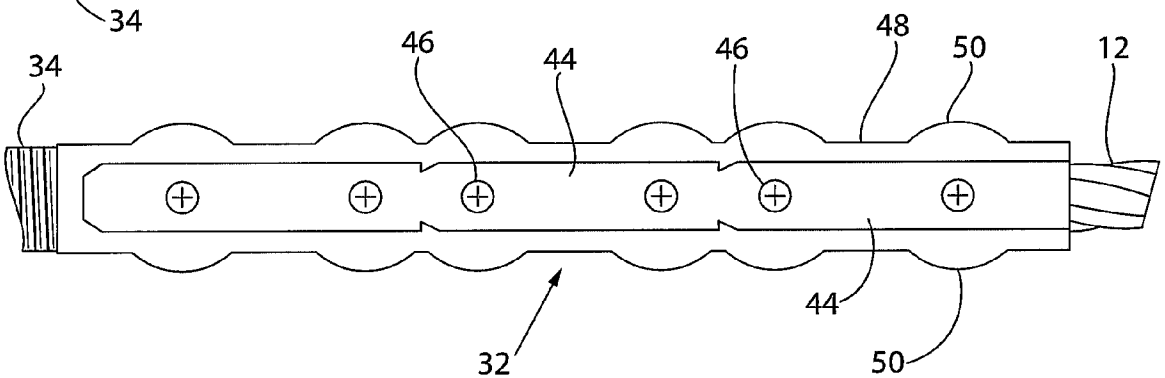
FIG. 2B is an enlarged side elevation of a shaft of the tensionable cable bolt of FIG. 1.

As can be seen in FIG. 1, the shaft 32 is crimped to the cable 12 in at least one location along its length. FIG. 2A provides an expanded view of a slightly modified anchor portion 16 of the cable bolt 10 shown in FIG. 1. In FIG. 2A, an expansion anchor 36' and barrel and wedge assembly 26' (as disclosed in U.S. 2009/0003940 to Oldsen et al., incorporated herein by reference) have slightly different configurations from those shown in FIG. 1 and no bearing plate 30 is present. FIG. 2B provides an expanded view of the shaft 32 of cable bolt 10. A crimp portion attaches the shaft 32 to the cable 12. The crimp portion includes a mechanical crimp having two parts, at least one primary crimp 44 and at least one secondary crimp 46. The secondary crimp 46 is disposed within the primary crimp 44. The secondary crimp 46 may be smaller in overall surface area and have a greater depth than the primary crimp 44. Both the primary 44 and the secondary 46 crimps may take any suitable shape or size as long as the shaft 32 is securely attached to the cable 12. For example, in FIGS. 2A and 2B, the primary crimps 44 are generally elongated and the secondary crimps 46 are circular. Two sets of crimps 44, 46 may be provided on opposing sides of the shaft 32, with only one side being visible in FIGS. 2A and 2B. Further, while a single row of crimps 44, 46 is shown extending along the longitudinal axis of the shaft 32, any number of crimps 44, 46 may be used to attach the shaft 32 to the cable 12 including, but not limited to, more than one row of crimps 44, 46 extending longitudinally along the shaft 32, crimps 44, 46 extending circumferentially around the shaft 32, and crimps 44, 46 placed randomly. When a plurality of primary crimps 44 and secondary crimps 46 are used, as in FIGS. 2A and 2B, they may be of uniform size and shape or may have different sizes and/or shapes. As long as the shaft 32 is securely attached to the cable 12, the size, shape, and location of the at least one primary crimp 44 and at least one secondary crimp 46 may take any suitable form.

The secondary crimps 46 may be placed anywhere within the primary crimps 44. For example, as shown in FIGS. 2A and 2B, the secondary crimps 46 may be placed near the longitudinal ends of the primary crimp 44. When a plurality of primary crimps 44 are used, the secondary crimps 46 may be placed randomly within each primary crimp 44 or may be placed in a pattern such that the secondary crimps 46 are located in the same position with respect to each primary crimp 44.

As previously described, the depth of the secondary crimps 46 may be greater than the depth of the primary crimps 44. For example, the primary crimps 44 may have a depth of about 1/16-1/8 in., while the depth of the secondary crimps 46 may be about 1/8-1/4 in. The secondary crimps 46 may also be of sufficient depth to bulge 50 a sidewall 48 of the shaft 32 outwardly in a region adjacent the secondary crimps 46 (exaggerated in FIG. 2B).

During insertion of the cable bolt 10 in a mine bore, a resin cartridge containing separate resin and catalyst components is inserted into the blind end of the bore hole. The cable bolt 10 is then inserted into the bore hole with a conventional bolting machine such that the resin cartridge ruptures, releasing the resin and catalyst components. Rotation of the drivehead 24 by the bolting machine rotates the entire cable bolt 10 which mixes the resin and catalyst components. The mixed resin flows along the first portion 14 of the cable 12, which in FIG. 1 has a mixing portion 18 to assist in mixing, and along the anchor portion 16. Because the shaft 32 is crimped to the cable 12, preventing relative axial movement between the cable 12 and the shaft 32, rotation of the drivehead 24 causes rotation of both cable 12 and shaft 32. In addition, while cable 12 and shaft 32 rotate, the plug 40 threads down the shaft 32, thereby urging the expansion shell 38 radially outward into gripping engagement with the wall of the bore hole. As the expansion shell 38 engages with the bore hole wall, the portion of the cable bolt 10 between the expansion anchor 36 and the drivehead 24 becomes tensioned. Engagement of the expansion shell 38 with the wall of the bore hole typically occurs before the mixed resin has set. Thus, this lower portion of the cable bolt 10 may be tensioned before the first portion 14 of the cable bolt 10 is fixed via the mixed resin to the rock strata.

Figure 3:
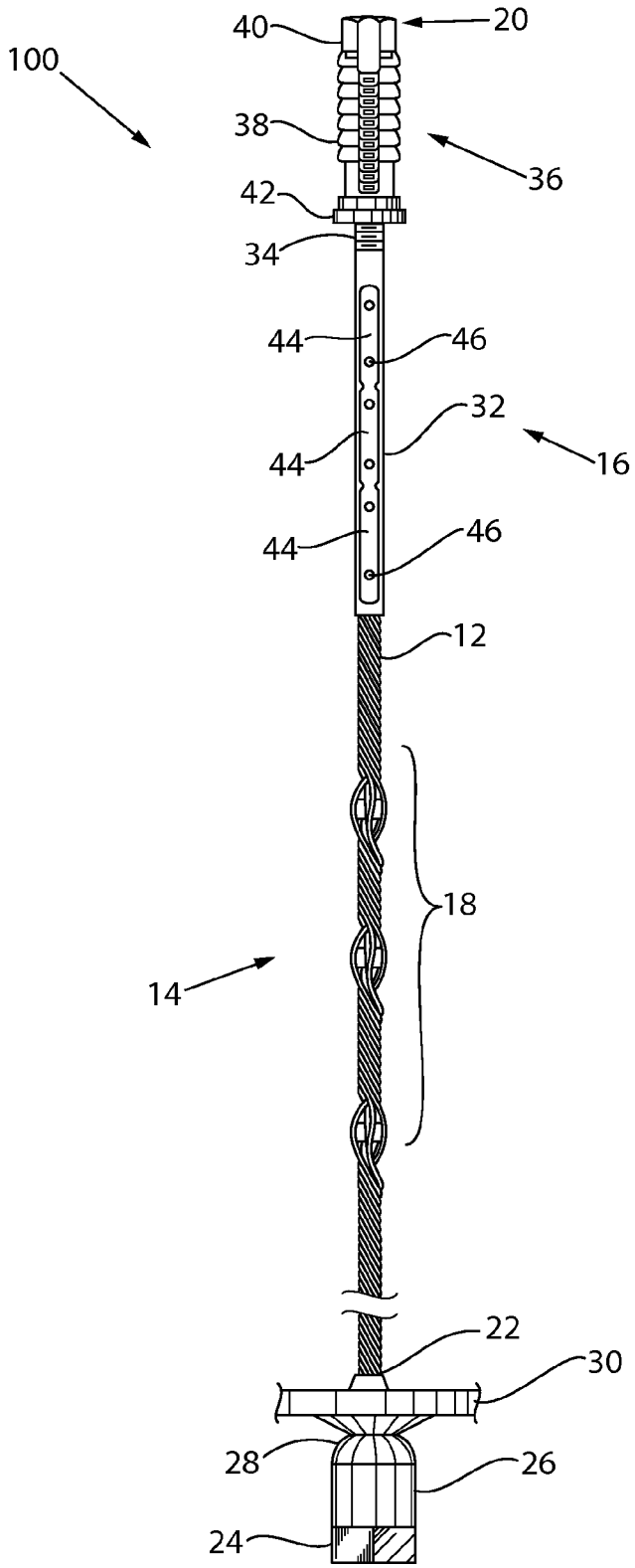
FIG. 3 is a side elevation of another tensionable cable bolt of the present invention.

In another embodiment, cable bolt 100, depicted in FIG. 3, the shaft 32 and expansion anchor 36 are fixed to the distal end 20 of cable 12 above the mixing portion 18.

Figure 4:
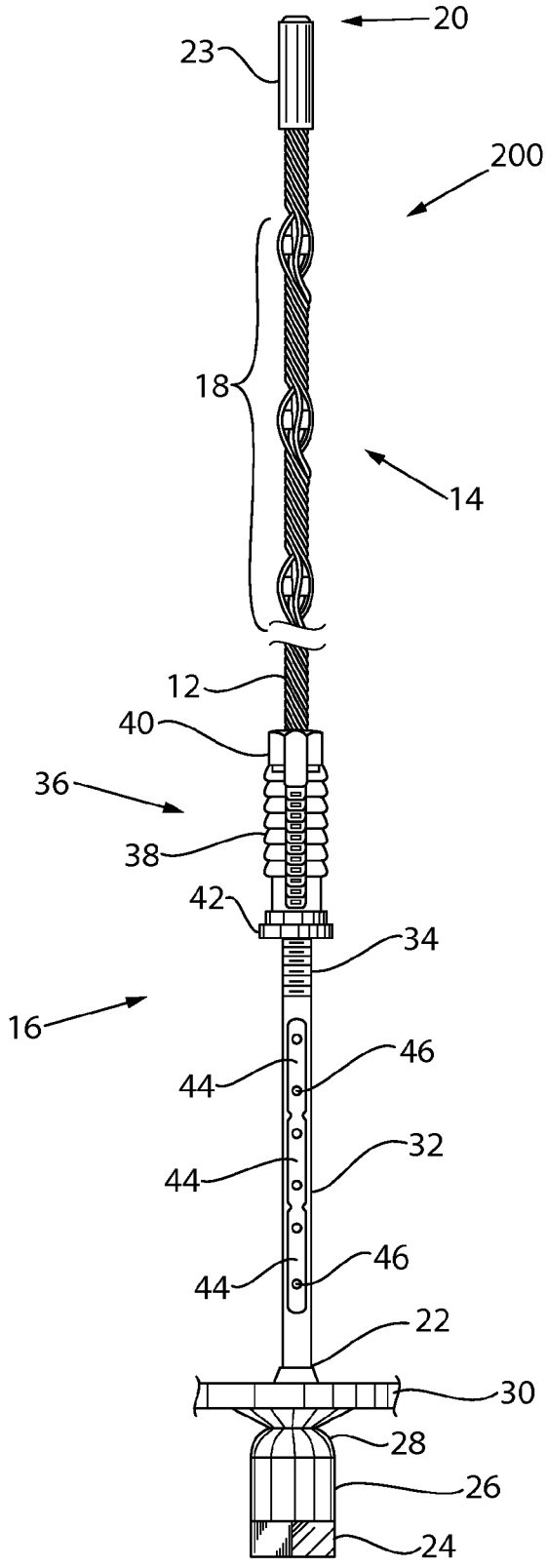
FIG. 4 is a side elevation of yet another tensionable cable bolt of the present invention.

In another embodiment, cable bolt 200, depicted in FIG. 4, the shaft 32 and expansion anchor 36 are fixed at the drive end (22) directly above the bearing plate 30 or, if no bearing plate 30 is used, are fixed directly above the barrel and wedge assembly 26.

The location of the shaft 32 and expansion anchor 36 can be selected according to the rock conditions. In some circumstances, stable rock is located near the mine roof and cable bolt 200 may be used to place tension in the cable bolt between the roof and the stable rock. It may instead be desirable to position the expansion anchor 36 higher in the rock strata and cable bolt 10 may be used. Cable bolt 10 allows for tensioning between the mine roof and rock strata in the vicinity of the lower portion of the birdcages. Other geological formations may require placement of the expansion anchor 36 at the blind end of the bore hole, with tensioning of the entire cable bolt, and cable bolt 100 may be used.

During installation, the crimping of the shaft 32 of the present invention provides advantages over prior art crimped shafts having only primary crimps. The secondary crimps 46 more securely attach the shaft 32 to the cable 12 allowing more torque to be applied to the cable 12 without the cable 12 disengaging from the shaft 32. This allows for greater tensioning of the cable bolt 10, 100, 200 since the cable 12 will not be able to rotate within the shaft 32 and the shaft 32 will fully engage the expansion anchor 36. In addition, in the case of cable bolts 10 and 100 where the shaft 32 is also exposed to the resin, the secondary crimps 46 provide additional surface area to which the resin will bond, further anchoring the cable bolt 10, 100 within the bore hole, and the slight bulge 50 of the sidewall 48 of the shaft 32 aids in mixing of the resin as the cable bolt 10, 100 is rotated in the bore hole.

A method for making a tensionable cable bolt according to the present invention will now be described. A multi-strand cable 12 having a distal end 20 and a drive end 22 is placed through an anchor portion 16 that includes a shaft 32 having a central bore adapted to receive the cable 12 and an inside diameter sized to accept the cable 12. The shaft 32 is then crimped in at least one location along its length to the cable 12. The crimp attaching the shaft 32 to the cable 12 is a mechanical crimp having two parts, at least one primary crimp 44 and at least one secondary crimp 46 within the primary crimp 44. The primary crimps 44 and secondary crimps may have any of the relative sizes, depths, shapes, and configurations previously described herein.

The primary crimps 44 and secondary crimps 46 may be formed in the shaft 32 at the same time or may be sequentially formed in the shaft 32. For example, the primary crimp 44 may be formed before the secondary crimp 46.

As previously described, the secondary crimps 46 may have greater depth than the primary crimps 44. For example, the primary crimps 44 may have a depth of about 1/16-1/8 in. while the depth of the secondary crimps 46 may be about 1/8-1/4 in. In addition, the secondary crimps 46 may also be formed with sufficient force to bulge 50 the sidewall 48 of the shaft 32 outwardly in a region adjacent the secondary crimps 46.

The method may further include threading an expansion anchor 36, as previously described herein, onto the end of the shaft 32 that is distal from the drive end 22 of cable 12 and provided with external threads 34 adapted to accept the expansion anchor 36.

The shaft 32 and expansion anchor 36 may be placed and crimped in any position along the cable 12, for example, at the distal end 20 of the cable 12 (FIG. 3), at the drive end 22 of the cable 12 (FIG. 4), or a location spaced apart from the distal end 20 of the cable 12 the distal end 20 (FIG. 1).

The method may also include providing a mixing portion 18 along the cable 12 as previously described. The mixing portion may be positioned between the shaft 32 and the distal end 20 of the cable 12 (FIGS. 1 and 4) or between the shaft 32 and the drive end 22 of the cable 12 (FIG. 3).

Although the invention has been described in detail for the purpose of illustration based on what is currently considered to be the most practical and preferred embodiments, it is to be understood that such detail is solely for that purpose and that the invention is not limited to the disclosed embodiments but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A tensionable cable bolt comprising:

(i) a length of multi-strand cable having a drive end and a distal end and being adapted to be resin grouted in a bore hole in rock; and (ii) an anchoring portion comprised of a shaft received on said cable, wherein said shaft is attached to said cable at a crimp portion comprising at least one primary crimp with at least one secondary crimp disposed within said primary crimp.

2. The tensionable cable bolt according to claim 1, wherein said cable further comprises a mixing portion.

3. The tensionable cable bolt according to claim 2, further comprising an expansion anchor threaded onto said shaft.

4. The tensionable cable bolt according to claim 3, wherein said mixing portion is positioned intermediate to said expansion anchor and said distal end.

5. The tensionable cable bolt according to claim 1, wherein the secondary crimp has a smaller surface area than the primary crimp, a greater depth than the primary crimp, or both.

6. The tensionable cable bolt according to claim 1, having a plurality of primary crimps and at least one secondary crimp within each primary crimp.

7. The tensionable cable bolt according to claim 6, wherein a plurality of secondary crimps are received within each primary crimp.

8. The tensionable cable bolt according to claim 1, wherein the primary crimps are about 1/16-1/8 in. deep and the secondary crimps are about 1/8-1/4 in. deep.

9. The tensionable cable bolt according to claim 1, wherein the primary crimps are generally elongated and the secondary crimps are generally circular.

10. The tensionable cable bolt according to claim 1, wherein in a region adjacent the secondary crimps shaft bulges outwardly.

11. A method of manufacturing a tensionable cable bolt comprising:

providing a length of multi-strand cable having a drive end and a distal end and being adapted to be resin grouted in a bore hole in rock;

providing an anchoring portion comprising a shaft;

extending the cable through the shaft; and crimping the shaft to the cable to form at least one primary crimp and at least one secondary crimp disposed within the primary crimp.

12. The method according to claim 11, wherein the cable comprises a mixing portion.

13. The method according to claim 11, wherein the secondary crimp has a smaller surface area than the primary crimp, a greater depth than the primary crimp, or both.

14. The method according to claim 11, wherein said crimping adjacent said secondary crimp causes a region of the shaft to bulge outwardly.

15. The method according to claim 11, wherein the primary crimp and the secondary crimp are sequentially formed on the shaft.

16. The method according to claim 11, wherein the primary crimp is formed in the shaft before the secondary crimp is formed.

17. The method according to claim 11 further comprising threading an expansion anchor onto the shaft.

18. The method according to claim 17, wherein the expansion anchor is positioned at the distal end of the cable.

19. The method according to claim 17, wherein the expansion anchor is positioned at a location spaced apart from the distal end of the cable.

20. The method according to claim 11, further comprising providing a resin mixing portion along the cable.

* * * * *